US005272954A

United States Patent [19]

Crouch

[11] Patent Number: 5,272,954

[45] Date of Patent: Dec. 28, 1993

[54] LAMINATED ARMOUR

[75] Inventor: Ian G. Crouch, Surrey, England

[73] Assignee: The Secretary of State for Defence in Her Britannic Majesty's Government of the United Kingdom and Northern Ireland, London, England

[21] Appl. No.: 594,440

[22] Filed: Sep. 28, 1990

[30] Foreign Application Priority Data

Oct. 4, 1989 [GB] United Kingdom ..... 8922340

[51] Int. Cl.[5] ..... F41H 5/04

[52] U.S. Cl. ..... 89/36.02; 109/82; 109/49.5

[58] Field of Search ..... 89/36.01, 36.02; 428/911; 109/80, 82, 83, 84, 49.5

[56] References Cited

U.S. PATENT DOCUMENTS

| | | | |
|---|---|---|---|
| 663,961 | 12/1900 | Donaldson | 89/36.02 |
| 4,090,005 | 5/1978 | Morgan | 428/911 |
| 4,131,053 | 12/1978 | Ferguson | 109/82 |
| 4,312,903 | 1/1982 | Molari, Jr. | 428/911 |
| 4,664,967 | 5/1987 | Tasdemiroglu | 89/36.01 |
| 4,836,084 | 6/1989 | Vogelesang | 89/36.02 |

FOREIGN PATENT DOCUMENTS

| | | | |
|---|---|---|---|
| 24713 | 3/1981 | European Pat. Off. | 89/36.02 |
| 1135342 | 8/1962 | Fed. Rep. of Germany | 89/36.02 |
| 2856085 | 6/1980 | Fed. Rep. of Germany | 89/36.02 |
| 865464 | 5/1941 | France | 89/36.02 |

*Primary Examiner*—Stephen M. Johnson
*Attorney, Agent, or Firm*—Nixon & Vanderhye

[57] ABSTRACT

Laminated armour comprising a first part (11) situated on the side of the armor from which attack is to be resisted and a second part (12) which is coextensive with the first part wherein: (i) each part comprises a lamination of first metal sheets (1) each having an average thickness $t_2$ adhesively bonded by interface layers (8) having a thickness ($t_1$) between $0.4t_2$ and $0.9t_2$ and a compressive Young's Modulus perpendicular to the layers below 4 GPa; (ii) the second part comprises material which is more ductile than the metal of the first metal sheets, and preferably comprises second metal sheets (2) which are bonded to each other and to the first part of the armor (11) with aramid fibre reinforced adhesive.

15 Claims, 3 Drawing Sheets

LAMINATED ARMOUR

BACKGROUND OF THE INVENTION

1. Field of the Invention

The present invention relates to laminated armour suitable for protection against small calibre kinetic energy rounds and particularly against fragmentation attack, but is also suitable as a containment means in a situation when there is a possibility of fragments being ejected at high speed for example during the operation of aircraft turbo fans.

2. Discussion of Prior Art

The terms "$V_{50}$ protection limit" and "merit rating" which are used in the description are defined as follows:

$V_{50}$ Protection Limit (m/s)—relates to attack with a particular type of projectile and represents the impact velocity which gives a 50% chance of armour defeat (by any failure mode).

$$\text{Merit Rating} = \frac{V_{50}}{\text{Armour's Areal Density}} \ (\text{m}^3/\text{kg s})$$

Merit rating provides a normalisation of $V_{50}$ results permitting comparison of armours with different areal densities (NB realistic comparison of different armours can only be made using merit rating provided the areal densities are of the same order.)

When attacked by armour piercing rounds or fragments from for example a fragmentation attack bomb, relatively lightweight armour is susceptible to a number of different failure modes. These are:

a. Plugging—in which local through thickness shear failure takes place resulting in a plug of material with a diameter of the same order as that of the projectile being removed from the armour. The plug itself may be ejected with residual kinetic energy and constitute a dangerous secondary projectile. Plugging is a low energy absorption mechanism because little plastic deformation of the armour takes place, and for this reason its avoidance is very desirable;

b. Discing or Scabbing—which involves the ejection of a disc of material spalled from the rear surface of the armour. This is also a low energy failure mechanism and is also to be avoided if possible, as it does not permit the full potential of the armour to be exploited;

c. Segmenting—which involves the formation of radial cracks defining segments of armour which bend rearwards away from the attacking projectile as it passes into the armour. Since this involves a considerable amount of plastic deformation and ductile fracture, this is a higher energy failure mechanism than plugging or discing.

Dual hardness armour systems have been proposed in the past which incorporate a hard ceramic layer for blunting or fragmenting the projectile on the armour's attack side, backed by a layer containing glass fibre reinforced resin which is designed to absorb the projectile's kinetic energy by deformation. Examples of such armours are described in French patent 823,284 and U.S. Pat. No. 4,131,053. Recently it has been proposed in EP patent 237095 to incorporate a fibre reinforced metal laminate into the armour system described above. All these armour systems are however applique i.e. only suitable for being applied to a structure. They are not suitable for use as structural armours themselves.

Dual ductility structural armours have been proposed in the past which incorporate a hard attack surface layer backed by a ductile spall prevention layer. In order that such armour will not distort under load the rear layer of ductile low strength metal commonly occupies 50% or more of the armour by volume with a consequential reduction in the armour's merit rating.

SUMMARY OF THE INVENTION

The object of the invention is to provide a structural armour with a high resistance to fragment penetration.

The inventors have found that where the attack face of a composite laminated armour is constituted by metal sheets separated by interface layers both the thickness and elasticity of the interface layers have a pronounced effect on the merit rating of the structural armour material. By choosing an interface layer thickness which is within a particular range and by selecting an interface layer material of sufficiently low Young's Modulus an optimisation of the armour's merit rating can be achieved.

Thus according to the invention there is provided a laminated armour comprising a first part situated on the side of the armour from which attack is to be resisted and a second part which is coextensive with the first part wherein:

(i) the first part comprises a lamination of first metal sheets each having an average thickness t adhesively bonded by interface layers having a thickness between 0.4 t and 0.9 t and a compressive Young's Modulus measured perpendicular to the layers of below 4 GPa, (ii) the second part comprises at least one metal sheet which is more ductile than the metal of the first metal sheets.

The thickness and low Young's Modulus of the first part interface layers allow the first part of the armour to make maximum use of the energy absorbing capabilities of the first metal sheets by permitting a high degree of independence of deformation. Crack propagation perpendicular to the first metal sheets (which could subsequently result in plugging), can be limited to the first metal sheets, leaving the second part of the armour to absorb any residual energy and also prevent discing taking place. Delamination of the armour also contributes to energy absorption, by spreading the area over which energy is absorbed by plastic deformation.

Preferably the first part layers have a compressive Young's Modulus measured perpendicular to the layers of below 3.5 GPa.

As typical polymeric reinforcing fibres increase the Young's Modulus of a typical resin matrix the first part interface layers are preferably fibre-free.

The second part of the armour may comprise a single sheet of ductile metal, but preferably comprises at least two ductile metal sheets bonded to each other and to the first part of the armour with aramid fibre reinforced adhesive. The incorporation of fibres into the second part of the armour significantly increases its energy absorbing capability. The ductility of the sheets allow the fibres which preferably constitute a fabric to stretch and in so doing absorb energy by inter-tow-friction. Furthermore the use of two or more ductile metal sheets and fibre reinforced adhesive layers results in an unexpected increase in the armour's merit rating compared to the use of one ductile sheet and one layer of fibre reinforced adhesive.

Selectively incorporating fibres into the second part of the armour can also raise the tensile load carrying capacity of the second part to the same order as that of the first part. The result is the possibility of producing a balanced structural engineering material which is less likely to distort under load. An additional advantage of this feature is that a higher percentage of the armour may be constituted by higher strength (lower ductility) metal with a consequent increase in the armour's merit rating. The first part preferably occupies at least 75% of the armour by volume. In order to prevent discing, prior art dual ductility armour systems have generally employed relatively thick ductile rear faces which commonly occupy 50% or more of the armour by volume. This leads to a consequential reduction in the armour's merit rating, because the penetration resistance of the armour is not maximised.

Preferably the strain to failure point of the first metal sheets is less than 14% and that of the material contained in the armour's second part is greater than 14%.

For resisting attack from typical small fragments the thickness t of each first metal sheet is preferably less than 2 mm. The thickness t may however be as high as 6 mm for resisting attack from larger fragments. The sheets are preferably independently selected from aluminium, titanium or magnesium or alloys thereof. The first part of the armour preferably comprises from four to ten first metal sheets.

The fibre reinforcement in the second part is preferably constituted by 2 orthogonal interwoven arrays of fibres. With this configuration of reinforcement the chance of crack formation and propagation within the adhesive layers is minimised.

BRIEF DESCRIPTION OF THE DRAWINGS

The invention will now be described by way of example only with reference to the accompanying figures in which.

DETAILED DISCUSSION OF PREFERRED EMBODIMENTS

Figure 2:
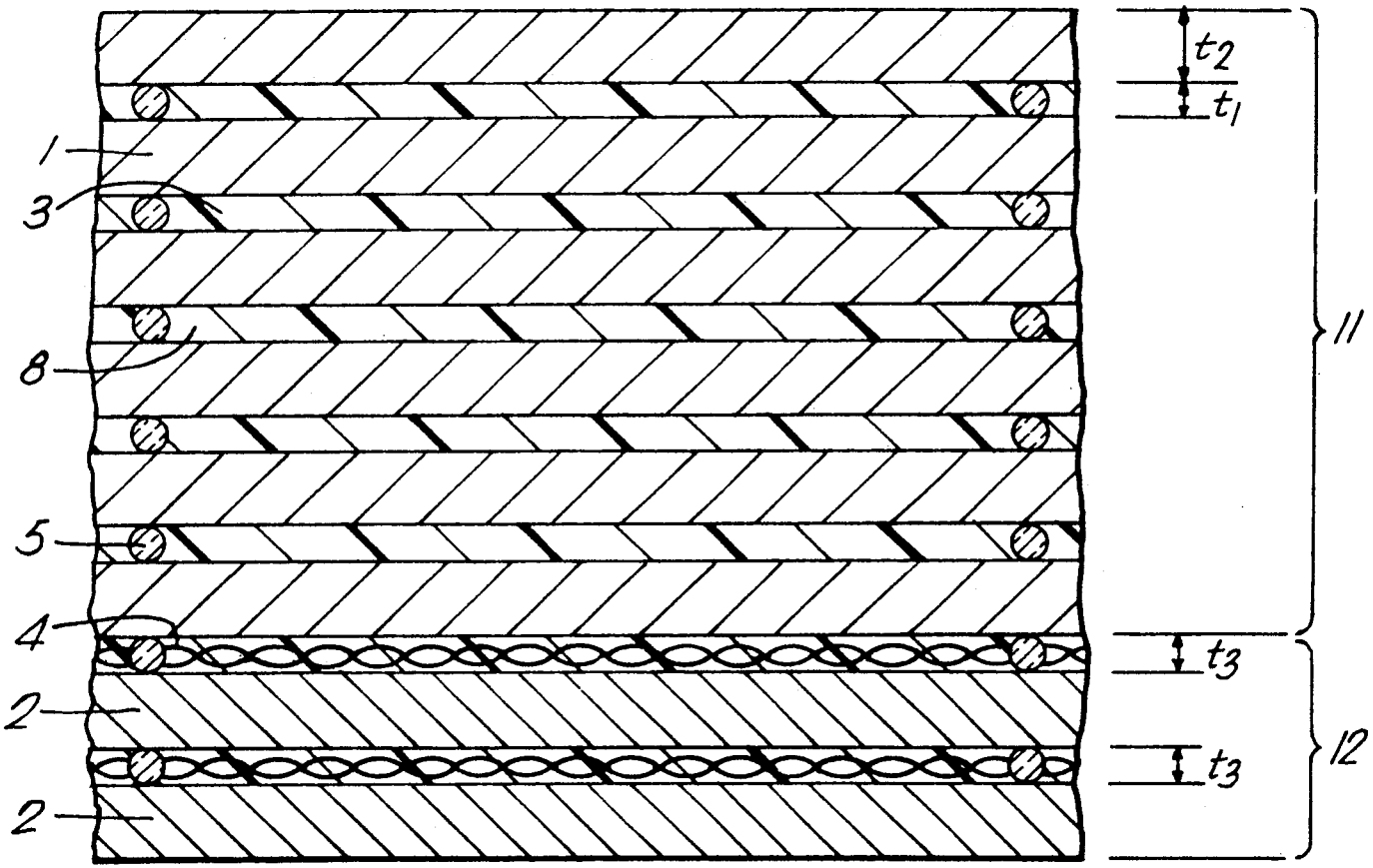
FIG. 2 shows a cross-section of armour according to the invention.

The armour plate shown in FIG. 2 is made in the following way (a) Six first metal sheets 1 of aluminium alloy 7075 T6 (1.02 mm thick) and two second metal sheets 2 of the more ductile aluminium alloy 5083 (1.0 mm thick) are degreased and given a room temperature pretreatment for 1 hour in a sodium carbonate bath ($Na_2CO_3$ 80 g/L in demineralised water);

(b) the sheets 1 and 2 are rinsed for 10 minutes with tap water;

(c) the sheets 1 and 2 are immersed for 4 hours in an etching solution conditioned with copper ions $H_2SO_4$ (Sg 1.84, 150 ml/L), $Na_2Cr_2O_7.2H_2O$(75 g/L), $CuSO_4.5H_2O$ (4 g/L), made up to 1 liter with demineralised water;

(d) then rinsed with tap water;

(e) then dried with warm air;

(f) bonding takes place within 6 hours of pretreatment steps (a)-(e);

(g) pieces of a plain weave Kevlar (RTM) fabric 4 previously scoured to remove the weaving size, are cut to size;

(h) equal quantities of adhesive are spread onto the faying surfaces of each sheet (toughened, two part epoxy Hysol-Dexter (RTM) 9309.3(NA));

(i) a single layer of the Kelar fabric is placed between and on top of the two second metal sheets 2 of 5083 aluminium alloy;

(j) the first metal sheets 1 are then assembled as shown in FIG. 2. All joints are provided with thickness regulating spacers 5.

The thickness $t_1$ (0.51 mm) of each interface layer 8 between the first metal sheets 1 is 50% of the thickness $t_2$ of the first metal sheets.

The thickness $t_3$ of the adhesive layer separating the second metal sheets from each other and from the remainder of the armour is 0.5 mm, this thickness being sufficient for the fibre occupancy described above.

(k) The armour plate is then placed under 30 psi (21092 $Kg/m^2$) in a press and heated to 60° C. for an hour to promote fluidity of the adhesive and thus thoroughly impregnate the fabric.

Figure 1:
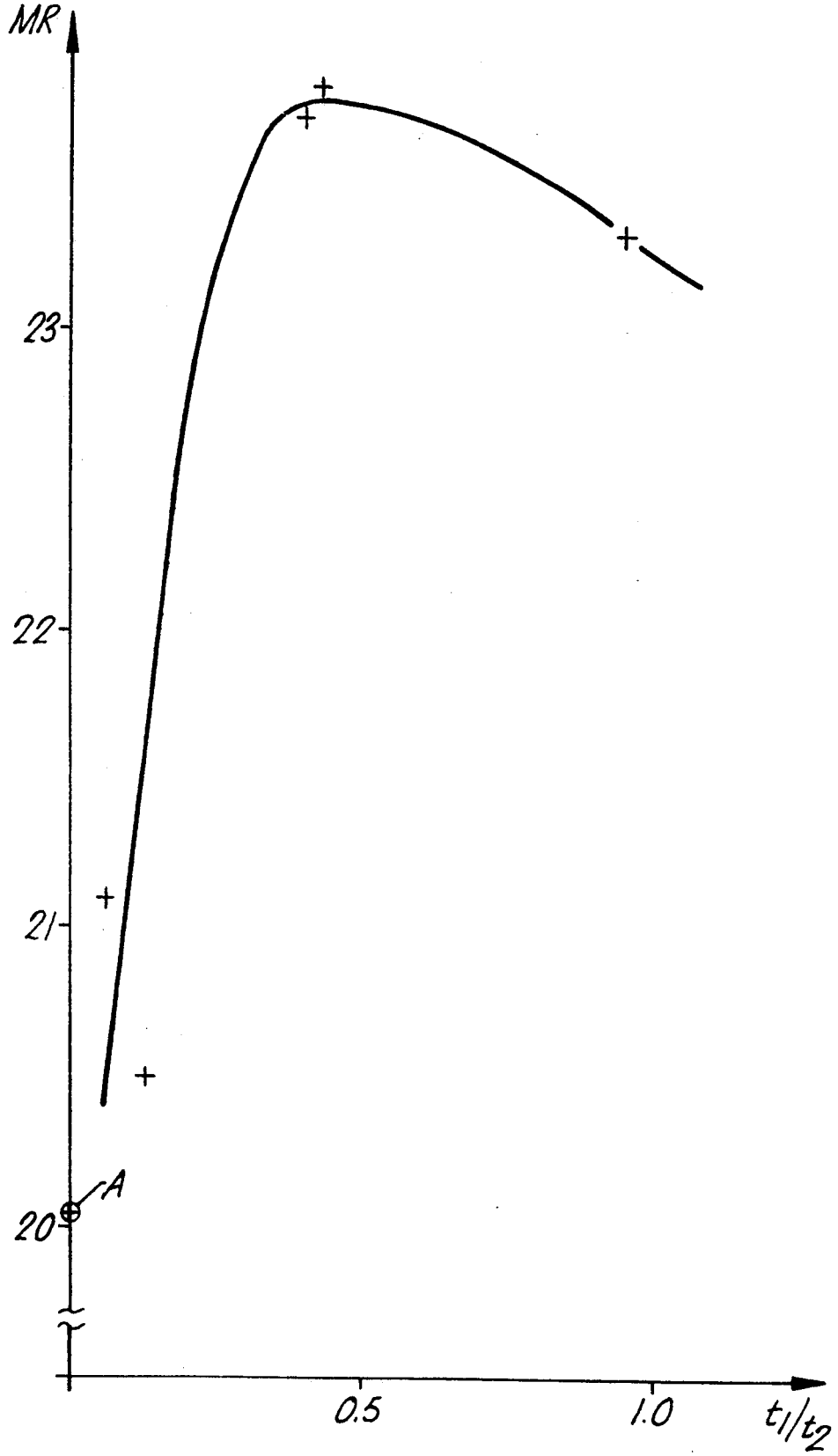
FIG. 1 is a graph showing how the merit rating of armour constructed according to the invention varies with the armour's interface layer thickness.
Figure 3:
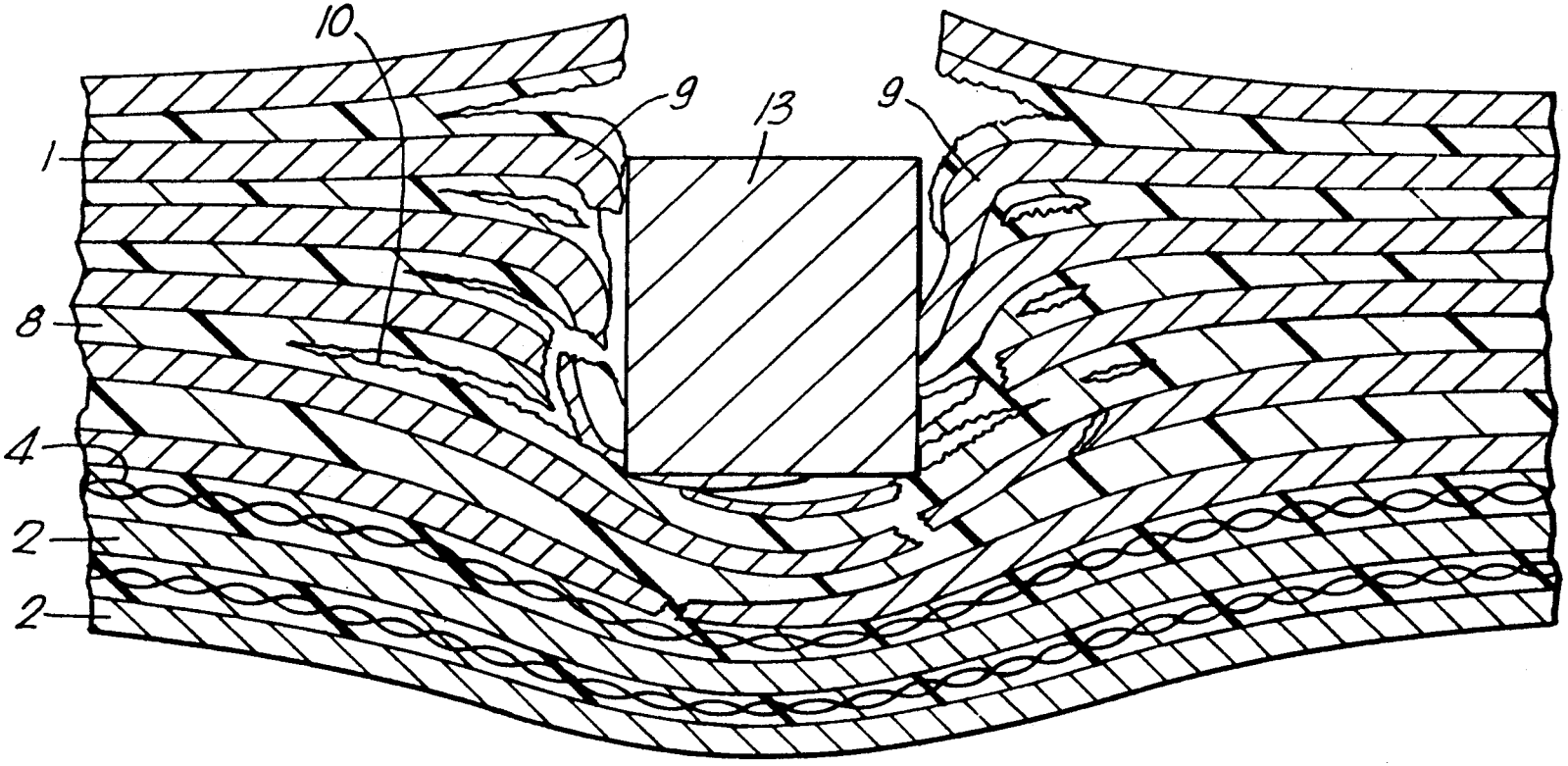
FIG. 3 shows a schematic cross-section of the armour according to the invention after attack with a high velocity blunt fragment simulating round.

A number of different armour plates constructed basically as described above each with a different interface layer thickness $t_1$ were tested to ascertain the armour's merit rating by being impacted with high velocity fragments 13 of varying velocities. The results are shown in FIG. 1 which is a graph showing the variation of merit rating (MR-$m^3$/kgs) against the ratio $t_1/t_2$ (interface layer thickness divided by first metal sheet thickness). The merit rating is optimised in the region of $t_1/t_2=0.5$ and is not significantly reduced within the range 0.4 to 0.9. The merit rating falls off as the fraction $t_1/t_2$ is reduced below 0.4 as a situation is approached where the interface layers are insufficiently thick to allow substantial independence of deformation of first metal sheets 1, and as a result failure by low energy through thickness plugging occurs. When armour having the optimum $t_1/t_2$ ratio just managed to resist complete failure the damage mode shown in FIG. 3 occurred. The first metal sheets 1 absorb a large amount of energy by plastic deformation at 9. This is possible (a) because of the thickness of the interface layers 8 and (b) because of the low Young's Modulus of the interface layers 8 3 GPa). The second metal sheets 2 in combination with the aramid fabric 4 prevent discing taking place, and also absorb energy by plastic deformation and inter tow friction.

By the avoidance of through thickness plugging greater delamination of the armour plate takes place by the formation of cracks 10. This has the advantageous effect of enlarging the area of armour acting to absorb a projectile's energy.

The resulting merit rating all compare favourably with that of monolithic aluminium armour of a comparable areal density, the merit rating of which is shown at point A in FIG. 1.

In order that the armour plate can constitute a useful stand alone balanced structural material the first part of the armour 11 and the second part 12 have been designed so that they respond similarly to applied loads and as a result the tendency of the armour to distort is minimised.

I claim:

1. Laminated armour comprising a first part situated on the side of the armour from which attack is to be resisted and a second part which is coextensive with the first part wherein:

(i) the first part is a laminate of first metal sheets each having an average thickness t adhesively bonded by interface layers having a thickness between 0.4 t and 0.9 t and a compressive Young's Modulus perpendicular to the layers below 4 GPa;

(ii) the second part comprises at least one second metal sheet which is more ductile than the metal of the first metal sheets.

2. Armour as claimed in claim 1 wherein the first part interface layers have a compressive Youngs Modulus perpendicular to the layers below 3.5 GPa.

3. Armour as claimed in claim 1 wherein the first part interface layers comprise fibre free resin.

4. Armour as claimed in claim 1 wherein the thickness t of each first metal sheet is less than 6 mm.

5. Armour as claimed in claim 1 wherein the first part comprises from four to ten first metal sheets.

6. Armour as claimed in claim 1 wherein the strain to failure point of the first metal sheets is less than 14% and that of material contained in the armour's second part is greater than 14%.

7. Armour as claimed in claim 1 wherein the second part comprises a laminate of at least two second metal sheets where are more ductile than the first metal sheets.

8. Armour as claimed in claim 1 wherein the metal sheets are independently selected from a list consisting of aluminium, titanium magnesium, and alloys thereof.

9. Armour as claimed in claim 7 wherein the second metal sheets are bonded with reinforced adhesive to each other and to the first part of the armour.

10. Armour as claimed in claim 9 wherein the reinforcement comprises fibres.

11. Armour as claimed in claim 10 wherein the fibres.

12. Armour as claimed in claim 10 wherein the fibre reinforcement comprises two aligned arrays of fibres which are mutually perpendicular.

13. Armour as claimed in claim 10 wherein the fibre reinforcement comprises at least two interwoven arrays of fibres.

14. Armour as claimed in claim 1 wherein the first part occupies at least 75% of the armour by volume.

15. Armour as claimed in claim 1 wherein the first and second parts have substantially the same response to applied loads thereby minimizing distortion under load.

* * * * *